US007168491B2

(12) United States Patent
Malone et al.

(10) Patent No.: US 7,168,491 B2
(45) Date of Patent: Jan. 30, 2007

(54) PERFORATION ALIGNMENT TOOL FOR JET DRILLING, PERFORATING AND CLEANING

(75) Inventors: Phillip G. Malone, Cottondale, AL (US); Michael E. Murphy, Moundville, AL (US); Floyd H. Briscoe, Northport, AL (US); William G. Buckman, Sr., Bowling Green, KY (US); Carl B. Hale, Franklin, KY (US); Adam W. Sears, Pewee Valley, KY (US)

(73) Assignee: Buckman Jet Drilling, Inc., Bowling Green, KY (US)

( * ) Notice: Subject to any disclaimer, the term of this patent is extended or adjusted under 35 U.S.C. 154(b) by 329 days.

(21) Appl. No.: 10/961,498

(22) Filed: Oct. 8, 2004

(65) Prior Publication Data

US 2006/0076137 A1 Apr. 13, 2006

(51) Int. Cl.
*E21B 43/11* (2006.01)
*E21B 43/26* (2006.01)

(52) U.S. Cl. ..... 166/298; 166/308.1; 166/55

(58) Field of Classification Search ..... None
See application file for complete search history.

(56) References Cited

U.S. PATENT DOCUMENTS 3,664,443 A * 5/1972 Campbell ..... 175/293
4,027,732 A 6/1977 Perkins
4,372,384 A * 2/1983 Kinney ..... 166/278
4,441,557 A * 4/1984 Zublin ..... 166/312
4,484,625 A 11/1984 Barbee, Jr.
4,518,041 A * 5/1985 Zublin ..... 166/312
4,793,417 A 12/1988 Rumbaugh
5,060,725 A 10/1991 Buell
5,135,051 A 8/1992 Facteau et al.
5,211,714 A 5/1993 Jordan
5,228,508 A 7/1993 Facteau et al.
5,318,128 A 6/1994 Johnson et al.
5,474,130 A 12/1995 Davis
6,173,773 B1 1/2001 Amagner
6,378,607 B1 4/2002 Ryan
6,378,611 B1 4/2002 Helderle
6,508,307 B1 1/2003 Almaguer

OTHER PUBLICATIONS

"Fluid-actuated Circulating Sub/Riser Jetting Tool", BJ Services Company, Mar. 13, 2003.

(Continued)

*Primary Examiner*—Frank Tsay
(74) *Attorney, Agent, or Firm*—Claude E. Cooke, Jr.; Burleson Cooke L.L.P.

(57) ABSTRACT

Method and apparatus are provided for pumping operations that may be used to form perforations in the casing of a well, clean perforations and drill drain holes through perforations. A plunger is placed in a reference perforation and the pumping operations may be performed through a nozzle at a known location with respect to the reference perforation. The nozzle may be attached to a flexible hose to drill a drain hole or may be inserted in a body on the bottom of a tubing string. Addition apparatus and method are provided to insure that the plunger or plungers are maintained in a reference perforation or perforations when pumping operations are carried out through tubing.

27 Claims, 8 Drawing Sheets

OTHER PUBLICATIONS

"Roto-Pulse$^{SM}$ Gravel Pack Cleaning", BJ Services Company, Aug. 12, 2003.
"Tubing Anchor/Catcher", BJ Services Company, Nov. 1, 2002.
"SandCADE software", Schlumberger, 1999.
"USPTO Search", Hits 1 thru 50, Search Terms: perforation, casing, jet, clean and spring, Jun. 30, 2004.
"USPTO Search", Hits 1 thru 50, Search Terms: Same as above plus ball, Jun. 30, 2004.

* cited by examiner

PERFORATION ALIGNMENT TOOL FOR JET DRILLING, PERFORATING AND CLEANING

BACKGROUND OF THE INVENTION

1. Field of the Invention

Apparatus and method are provided for locating and performing an operation in a wellbore with respect to a reference perforation. More specifically, forming perforations in the casing of wells at a selected location with respect to a reference perforation, cleaning perforations at a selected location and jet drilling through perforations at a selected location into an underground formation surrounding the casing are disclosed.

2. Description of Related Art

Perforations are formed in the casing of wells to allow fluid to pass to or from the wellbore. Perforations are usually formed by shaped charges, using well known technology. It is also well known to form perforations by abrasive jets. Often, the perforations in wells become plugged or partially plugged or "damaged," which decreases the ability to produce or inject fluids through the wells. A large variety of chemical, mechanical and hydraulic methods have been proposed for decreasing or removing damage to flow in perforations. An example of a hydraulic method is that disclosed in U.S. Pat. No. 5,060,725, where the use of multiple jets created by pumping fluid downhole and through a tool containing multiple nozzles is disclosed. The tool is rotated and reciprocated inside a casing while pumping high-pressure fluid through the nozzles to wash perforations. Jet drilling of drainholes from wells is also well known. For example, U.S. Pat. No. 6,668,948 discloses a nozzle suitable for drilling through the casing of a well to form a perforation and then continued drilling into the surrounding formation before the nozzle is withdrawn into the well.

What is needed is apparatus and method for forming a perforation in casing in a selected location with respect to a reference perforation, jet cleaning a perforation that is located at a selected location with respect to a reference perforation by a stationary fluid jet that is concentrated on that perforation and drilling a drain hole through a perforation that is at a selected location with respect to a reference perforation.

BRIEF SUMMARY OF THE INVENTION

Apparatus for fixing a second apparatus to a reference perforation in a well casing is provided. A spring-loaded plunger to at least partially enter a perforation establishes the reference perforation. The plunger may include a ball that can rotate as the apparatus is placed down a well. A plurality of plungers may be provided in the apparatus. The second apparatus may be a body including a fluid channel leading to a nozzle that is located at a known distance along the axis from the plunger and is directed at a known phase angle with respect to the plunger. The nozzle may be selected to form new perforations in casing or to jet-clean existing perforations that are at a known location with respect to the reference perforation. A plurality of nozzles may be provided. The location of perforations with respect to a reference perforation may be determined by forming the perforations in a known pattern or using downhole tools to locate the existing perforations in a well. A slip joint to isolate tubing movement from the apparatus containing nozzles is provided, along with methods for preventing movement of the bottom of a tubing string during the pumping operations. Apparatus and method are provided for applying fluid jets through a body on the bottom of tubing or jet-drilling lateral drain holes through perforations. The drain holes may be drilled from a second tubing string inside a first tubing string by guiding a flexible tubing with nozzle attached through a perforation.

DESCRIPTION OF THE DRAWINGS

For a more complete understanding of the present invention and the advantages thereof, reference is now made to the following description taken in conjunction with the accompanying drawings in which like reference numbers indicate like features wherein.

DETAILED DESCRIPTION OF THE INVENTION

Figure 1:
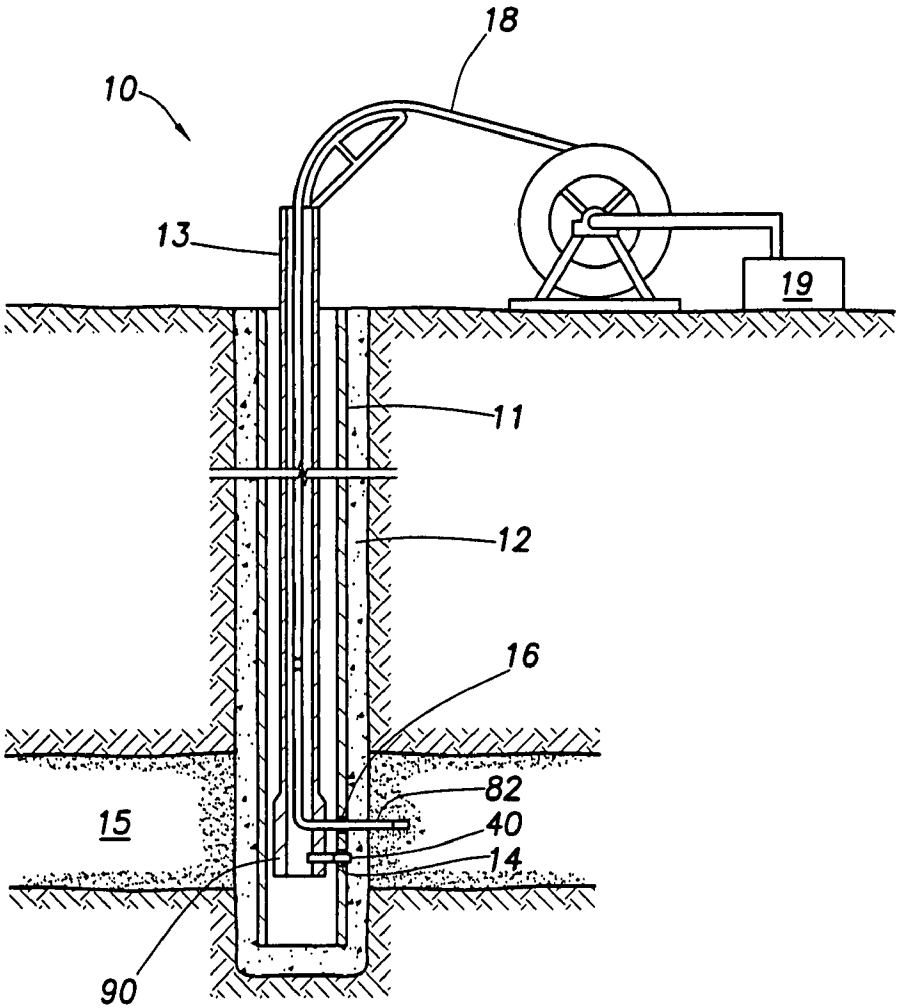
FIG. 1 illustrates a well having a reference perforation and a perforation alignment tool assembly that is configured for drilling, the assembly having a nozzle for drilling through a perforation at a fixed position with respect to the reference perforation.

Referring to FIG. 1, well 10 has been drilled through subterranean formation 15 and casing 11 has been cemented in the well using cement 12. Tubing 13 has been placed in the well with perforation alignment tool assembly 90, configured for drilling, attached to the bottom of the tubing.

Prior perforation 14 was present in casing 11 when tubing 13 was placed in the well and serves as a reference perforation. Tubing 13 was manipulated into position such that the plunger of plunger unit 40 has penetrated perforation 14, which allows pumping operations for perforating, perforation cleaning or jet drilling to be performed in the well through perforations having a known location with respect to perforation 14. "Known location" means at a known distance along the axis of the wellbore from prior perforation 14 and at a known angle (phase angle) around the axis of the wellbore with respect to perforation 14. The pumping operations may include forming one or more additional perforations, jet cleaning existing perforations, or drilling through an existing perforation. FIG. 1 illustrates drilling through existing perforation 16, which already exists at a known distance and phasing with respect to perforation 14, using flexible drilling conduit 82. Fluid for the drilling operation, or for other operations through perforations or into perforations, may be supplied through coil tubing 18 using pump 19.

Figure 2:
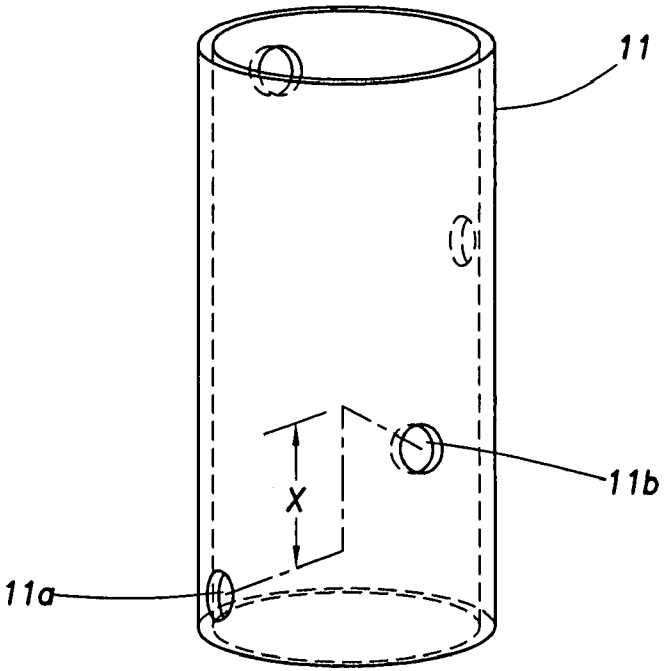
FIG. 2 is a three-dimensional perspective view of a foot-long segment of casing having perforations in a selected pattern of 90-degree phasing and about 4 shots per foot.

Referring to FIG. 2, a segment of casing 11 is illustrated. Perforations 11*a* and 11*b* are shown. Applications of the perforation alignment tool allow formation of perforations in casing 11 at known distances along the well bore, x, and at known phasing of the perforations with respect to a reference perforation. For example, perforations 11*a* and 11*b* are illustrated at 90-degree phasing, or 90 degrees apart. Many different phase angles, from 0 to 180 degrees, are commonly used in industry. A common perforation density is 4 shots per foot, in which case x would equal three inches, but perforation density may vary from higher values to much lower perforation density.

Figure 3B:
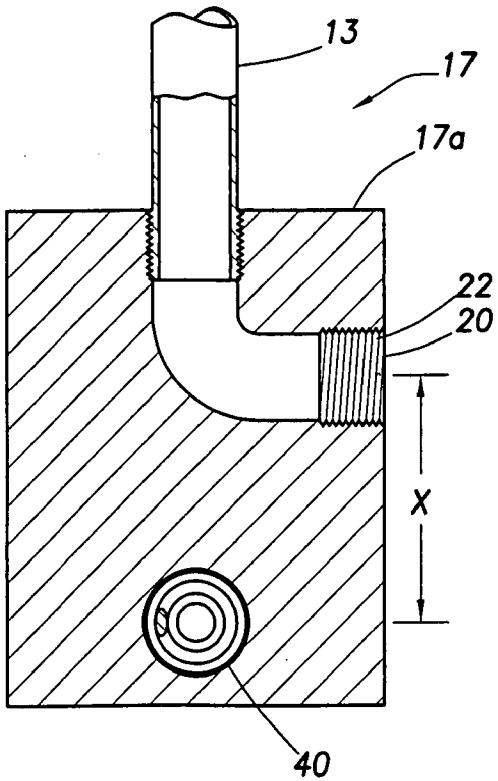
FIGS. 3*a* and 3*b* are orthogonal cross-sectional views of a perforation alignment tool piece configured for jetting, the piece having a flow path to a nozzle connection and a plunger for aligning the tool to a reference perforation.
Figure 3A:
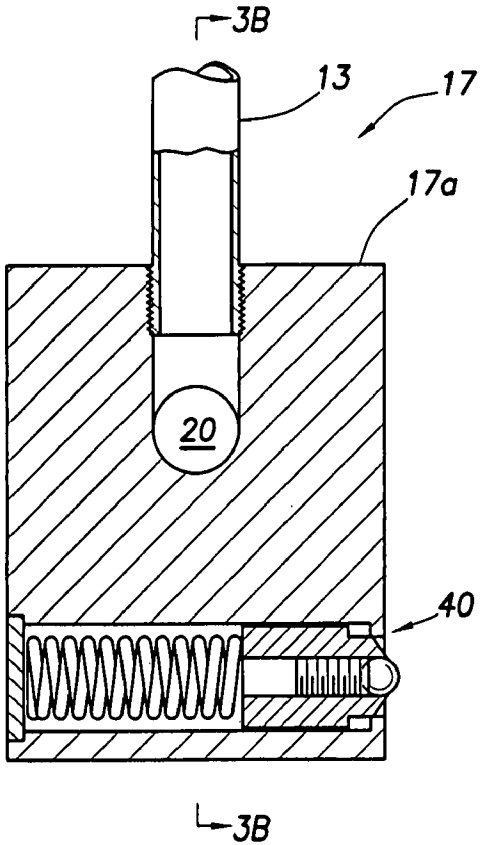

Referring to FIG. 3*a*, perforation alignment tool piece 17 is adapted for orienting a fluid jet with respect to an existing perforation. Body 17(*a*) is attached to the bottom of tubing string 13. Grooves may be formed on the outside surface of body 17(*a*) (not shown) to provide lower flow resistance to fluid and cuttings passing by the tool. Fluid channel 20 is formed through body 17(*a*). Plunger unit 40, which will be described in more detail below, is oriented at a 90-degree phase angle with respect to flow channel 20. Although plunger unit 40 is shown in the same body as flow channel 20, it should be understood that plunger unit 40 is considered to be part of its own separate body, which may be contiguous with the body containing flow channel 20 or attached to that body. The phase angle between plunger unit 40 and fluid channel 20 may be varied from 0 to ±180 degrees. FIG. 3*b* is a cross-sectional view in plane 3B, as shown in FIG. 3*a*. Threads 22 are adapted to receive a nozzle, which will be described below. The center-to-center distance between plunger unit 40 and channel 20 is a selected distance, x. A nozzle may be inserted in channel 20 that is particularly adapted for forming a new perforation in casing or a nozzle may be placed in channel 20 that is particularly adapted for jet cleaning an existing perforation. In an embodiment using a perforation alignment tool configured for forming a new perforation, distance x and a phase angle will be selected to drill the new perforation at a known location. In an embodiment using a perforation alignment tool configured for cleaning an existing perforation or for drilling through an existing perforation, it is required that the distance x and the phase angle of the perforation to be cleaned or to be drilled through be known with respect to a reference perforation, so that the perforation alignment tool piece can be constructed having the same distance x and the same phase angle. At least one plunger will be locked into a reference perforation. Two or more plungers may be locked into perforations to increase the force required to release the tool piece from a known fixed position with respect to a reference perforation or reference perforations.

Figure 4B:
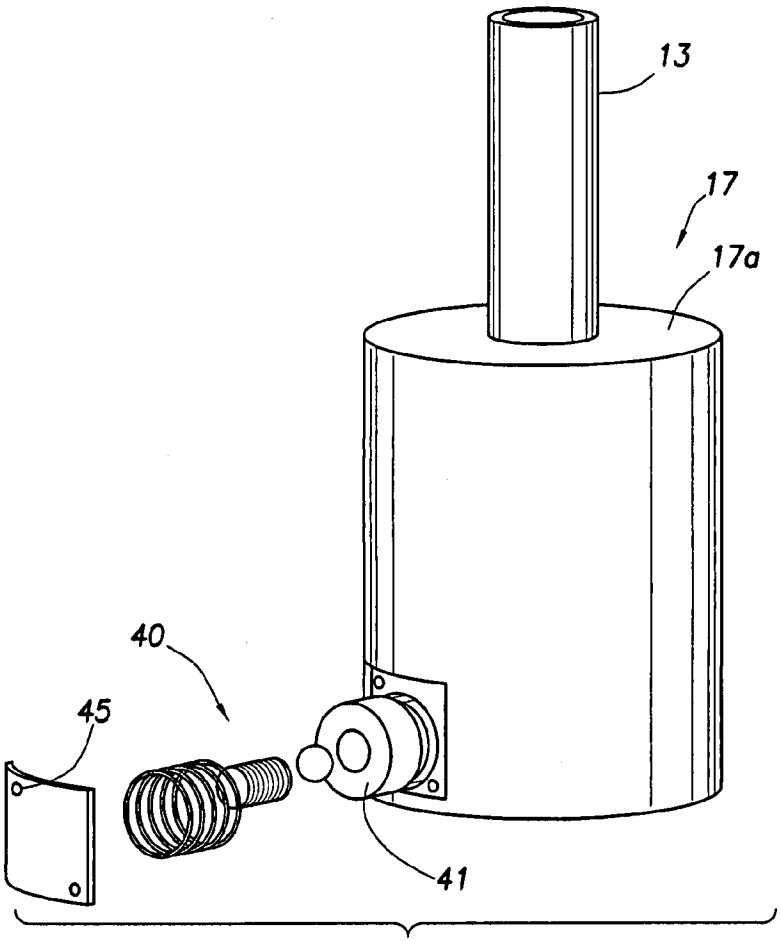
FIGS. 4*a* and 4*b* are perspective views of a perforation alignment tool piece configured for jetting and showing details of the plunger assembly for aligning the piece to a reference perforation.
Figure 4A:
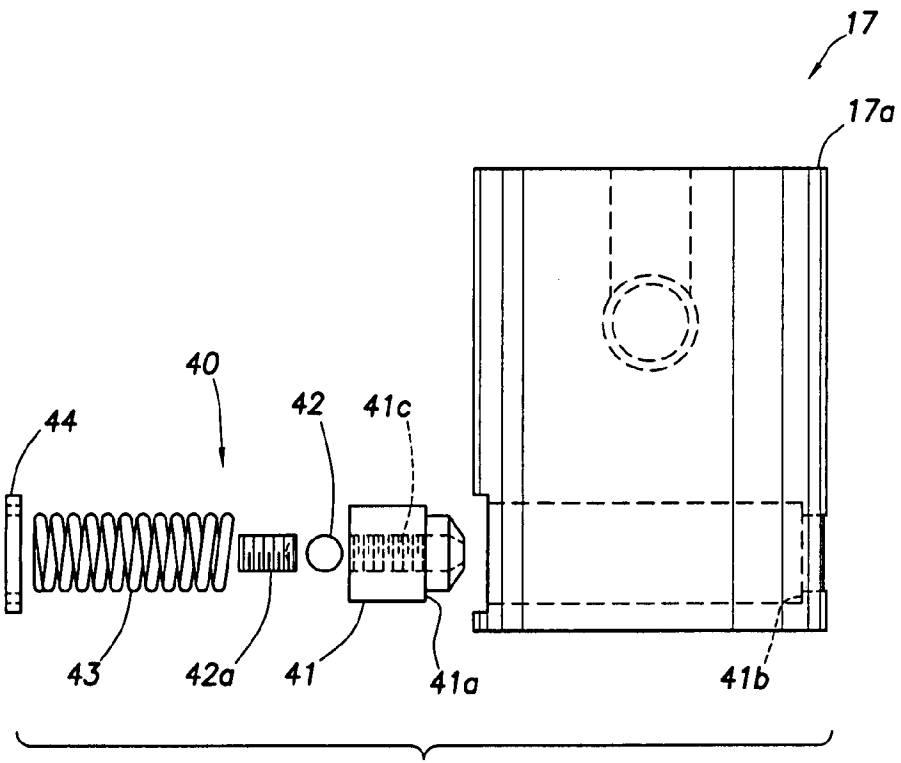

Plunger unit 40 is illustrated in more detail in FIG. 4*a* and FIG. 4*b*. In a preferred embodiment, shown in FIG. 4*a*, plunger body 41 is adapted to slidably move through a bore in body 17(*a*) of the perforation alignment tool. Shoulder 41*a* is at a selected distance from the end of body 41 that is adapted for entering a perforation and is adapted to be stopped by stop 41*b*. Threaded bore 41*c* is formed through the center of plunger body 41. Ball 42 is adapted to move through bore 41*c* to a restricted diameter in bore 41*c*, which is adapted to retain ball 42 within bore 41*c*. Screw 42*a* preferably is adapted to thread into channel 41*c* and restrain ball 42 within the bore. Screw 42*a* may be a set screw. Preferably, screw 42*a* includes a round indentation adapted to receive a segment of ball 42. Screw 42*a* is preferably placed within bore 41*c* such that ball 42 is confined but free to rotate as tool 17 is lowered into a well bore. This rotation will minimize wear on ball 42 as it contacts the casing going into a well. Spring 43 is selected to provide a force to body 41 to cause ball 42 to enter a perforation if it is placed opposite the perforation, as illustrated in FIG. 3*a*, and to maintain body 41 and ball 42 in the perforation until a selected force is applied to body 17*a*. Plate 44 confines spring 43 and other parts in body 17(*a*). A perspective view of plunger unit 40 is shown in FIG. 4*b*. Screws 45 may be used to attach plate 44 to body 17(*a*). The spring force on plunger body 41 may be large enough to prevent movement of the plunger unit out of the perforation while fluid is being pumped down the tubing and through a nozzle. Preferably, the spring force is not so large that the plunger cannot be removed from a perforation by application of torque or axial force on tubing 13. A typical value of spring constant for a perforation alignment tool to be used in 5½-inch casing for forming perforations, perforation washing or jet drilling is 310 lbs per inch. For this spring constant, it was found that the beveled edge on plunger 41 should have an angle of about 60 degrees. A beveled edge at 45 degrees required more than an optimum range of force to remove the plunger from a test 0.9-inch perforation. The diameter of ball 42 may be selected according to the size of perforations. The diameter will usually be in the range from about 0.5 inch to about 1 inch. The diameter of plunger body 41 will usually be in the range from about 1 inch to 1.5 inches. In one embodiment, when shoulder 41*a* is seated on stop 41*b*, ball 42 extends beyond body 17*a* by about 0.5 inch. These dimensions and spring constant may be selected as perforation size and condition, pumping conditions that may alter the force required to maintain plunger 41 in a perforation and other variable conditions arise. Alternate spring mechanisms may be used, such as compressed gas between plunger body 41 and plate 44, with gas pressure confined by seals and using well known methods.

If pumping conditions are such that the force on body 17*a* exerted by movement of tubing 13 during pumping operations is greater or may be greater than the force that will remove the plunger from a perforation, one or more methods and types of apparatus may be employed to fix the position of body 17*a* in a casing. These methods and apparatus will be described in more detail below.

Figure 5A:
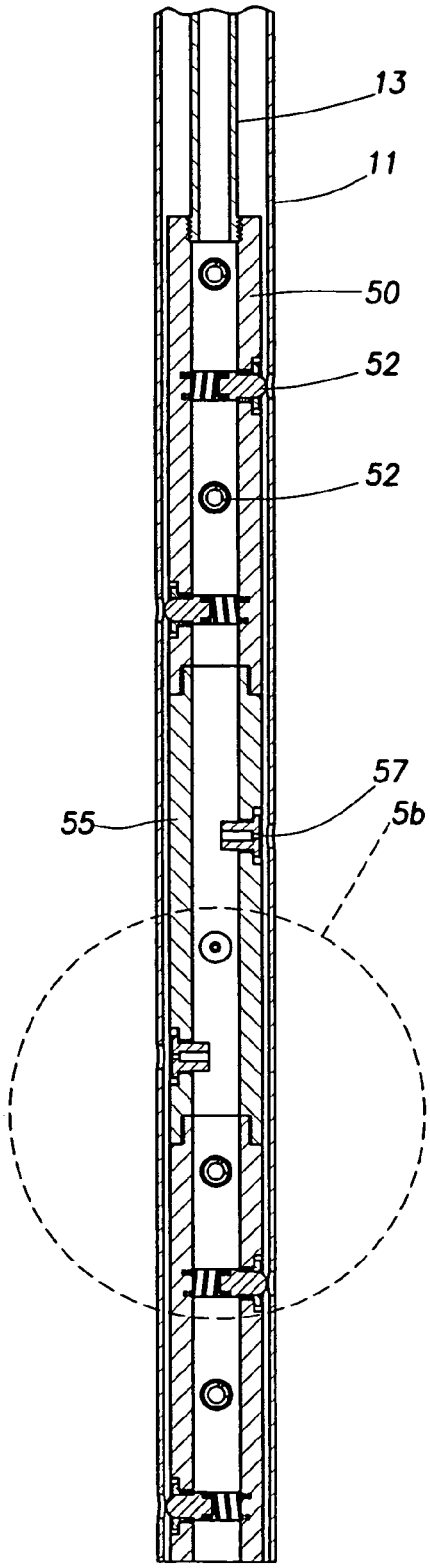
FIGS. 5*a* and 5*b* are cross-sectional views of a perforation alignment tool assembly having a plurality of nozzles and plungers for aligning the tool to a plurality of perforations.

FIG. 5*a* illustrates the use of multiple plunger units and nozzles in joined or connected sections of a perforation alignment tool assembly used for forming perforations by fluid jets or for jet-cleaning of perforations. Tool assemblies are normally placed in a well on tubing string 13. Tubing string 13 may be jointed tubing or coiled tubing. Plunger section 50 of the assembly includes four plunger units 52, the plunger units being at 90 degree phasing. The number of plunger units in a section may vary from one to ten or more. Nozzle section 55 includes a selected number of nozzles 57, also at a selected phasing that preferably places the nozzles opposite or aligned to existing perforations, if present. The number of nozzles used depends on the number of perforations to be formed or the number of existing perforations that are to be jet-cleaned. A selected number of nozzle sections and plunger sections may be joined in a tool assembly, depending on the existing perforations to be jet-cleaned and/or on the additional perforations that are to be formed. The plunger units are selected in accord with the number and the location of existing perforations in a casing. The number of plungers used on a tubing string may be increased when a greater force may be required to maintain plungers in perforations while forming new perforations, jet cleaning perforations or drilling through perforations. Higher pumping pressures, greater change in temperature of tubing while pumping fluids (for example, because of colder fluids being pumped) and longer or higher-strength tubing strings may require greater force to maintain plungers in perforations. Commercially available software may be used to calculate the movement of the bottom of a tubing string, or calculate the force developed when the bottom is fixed, as a result of pressure and temperature changes in the tubing string during pumping operations. Such software is available from service companies (for example, the "Wellcat" program from Halliburton, the tubing movement module in the "FracCADE" program from Schlumberger, or various other sources).

Figure 5B:
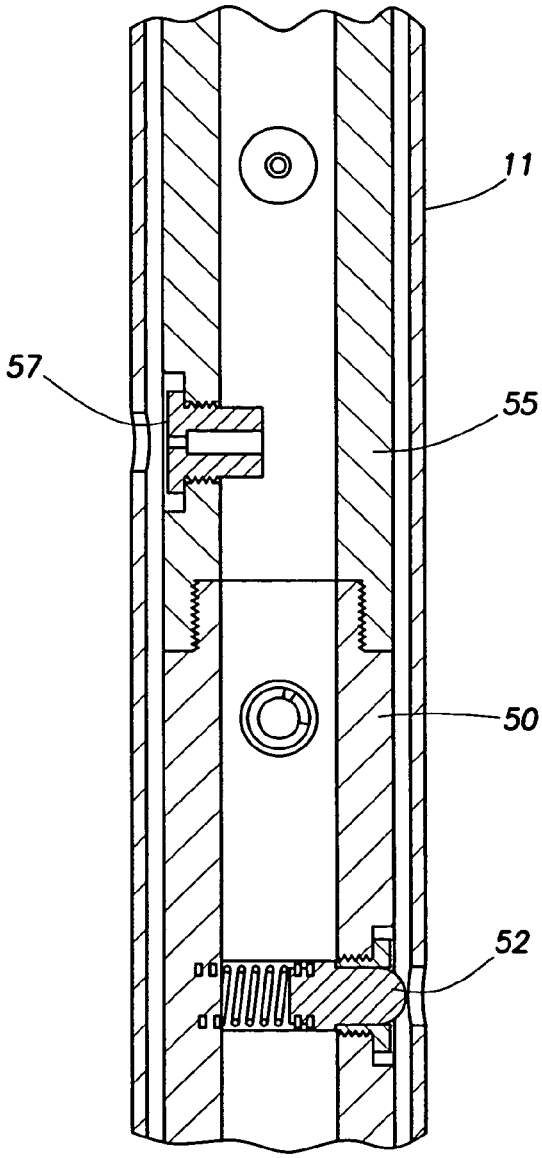

An expanded view of portions of sections 50 and 55 of a perforation alignment tool assembly is shown in FIG. 5*b*. Nozzles 57 are selected according to the operation to be performed and will be described in more detail below. FIG. 5*b* illustrates a different embodiment of plunger 52 than shown in FIGS. 3 and 4. In the embodiment illustrated in FIG. 5, the plunger assembly, including a spring and a body having a round end adapted to enter a perforation, may be inserted into a bore that does not extend through the body of section 50. A rounded or dome-shaped body may be used without a ball, or a ball may be incorporated into the body as shown in FIG. 3. The spring and body may be held in place by an external screw, as shown. The end of plunger 52 may be hardened to minimize wear as the perforation alignment tool assembly is placed in a well. Preferably, the spring is selected to assert a selected force, as described above.

Figure 7A:
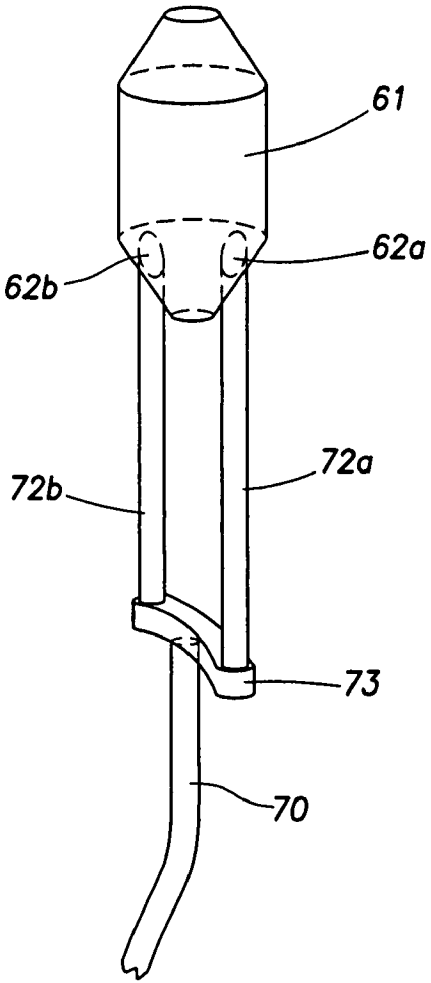
FIG. 7 is a cross-sectional view of a perforation alignment tool assembly configured for jetting to form perforations or to jet-clean perforations or for drilling into a formation through a perforation in a selected location with respect to a reference perforation that is penetrated by a plunger for aligning the assembly to the reference perforation.
Figure 6:
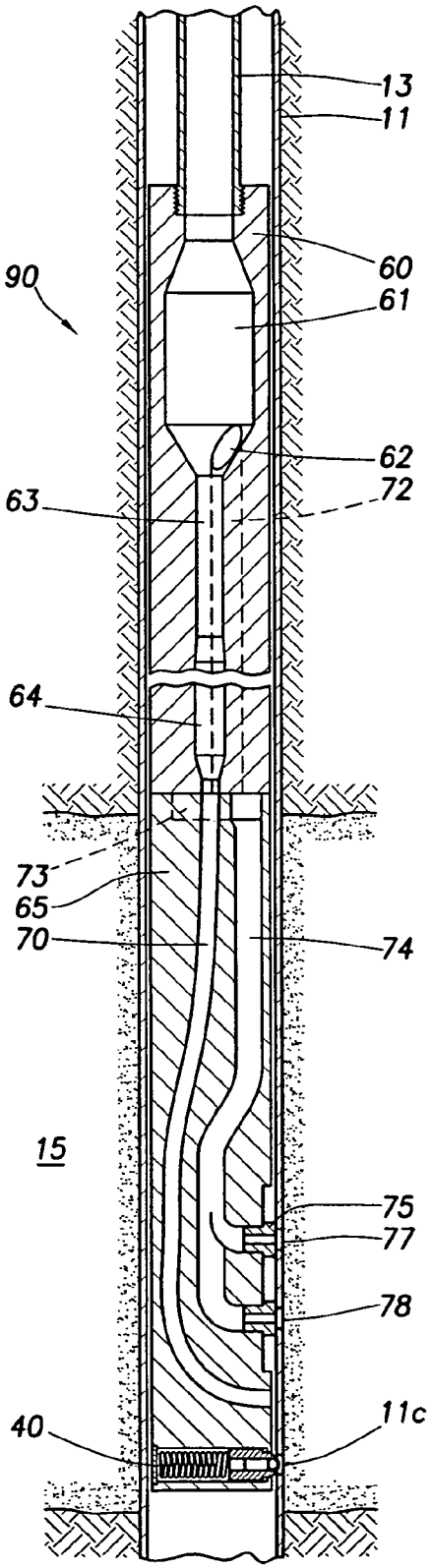
FIG. 6 is a cross-sectional view of a perforation alignment tool assembly configured for jetting to form perforations or to jet-clean perforations at a selected location with respect to a reference perforation that is penetrated by a plunger for aligning the assembly to the perforation.
Figure 7:
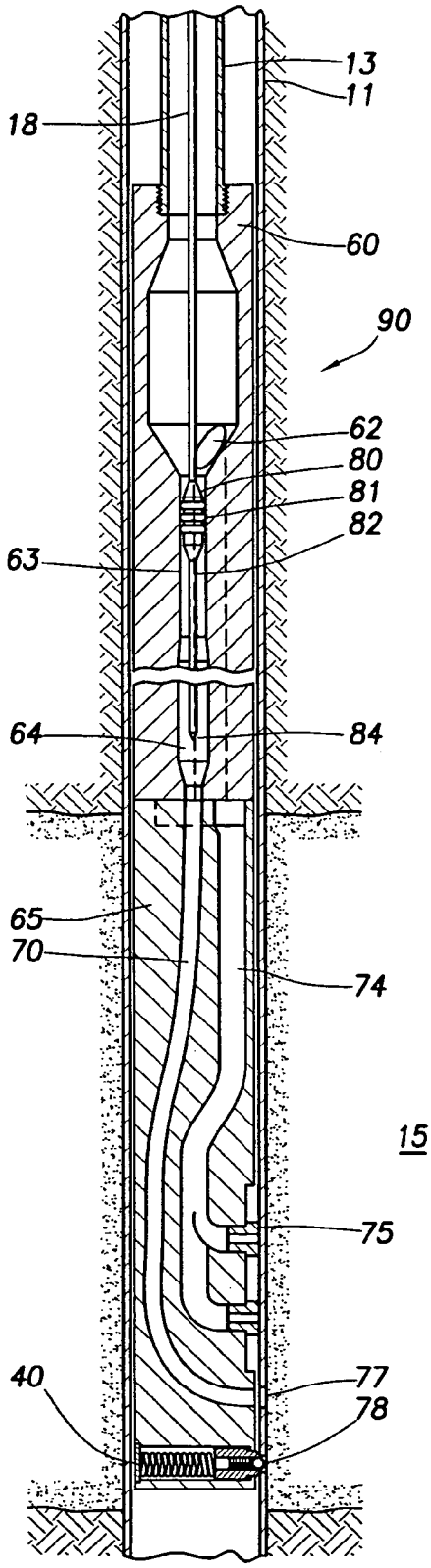

Referring to FIGS. 6 and 7, an embodiment of perforation alignment tool assembly 90 configured for forming perforations into formation 15 using high pressure jets or jet drilling into formation 15 using a nozzle on flexible tubing is illustrated. The additional equipment to be inserted into tool 90 for jet drilling into a formation is shown only in FIG. 7. Referring to FIG. 6, plunger unit 40 has been aligned to perforation 11*c* and has entered the perforation. Upper section 60 and lower section 65 of tool 90 have been placed in the well in a known orientation with respect to plunger unit 40. Plunger unit 40 may be placed in the body of lower section 65, the body of upper section 60 or may be placed in a separate body that is joined to one of the other bodies. For purposes herein, it is considered to be in a separate body that contains the plunger. Section 60 and 65 are normally placed in the well at the bottom of tubing 13, and may have grooves in the outside surface (not shown) to decrease flow resistance of fluid and cuttings passing by the tool. Preferably, the difference in the outside diameter of sections 60 and 65 and the inside diameter of casing 11 is in the range from about 0.2 inch to about 1 inch, but the difference in diameters may be more or less. Centralizers may be placed on the outside of sections 60 and 65 or on nearby tubing above or below sections 60 and 65 (not shown). Chamber 61 provides for sending flow out through port 62 into flow channel 72, flow channel 74 and nozzles 75. In the illustration of FIG. 6, perforations 77 and 78 already exist and are to be cleaned by a high-pressure fluid jet. Therefore, nozzles 75 are selected for cleaning perforations. The distance and orientation of perforations 77 and 78 with respect to reference perforation 11*c* must be known. If the perforations do not exist, nozzles may be selected for penetrating casing 11 to form new perforations at a selected distance and orientation with respect to perforation 11*c*. If assembly 90 is to be used only for forming additional perforations or cleaning perforations at a known distance and phase angle with respect to reference perforation 11*c*, guide channel 70 may be deleted in lower section 65. Alternatively, guide channel 70 or a channel leading to channel 70, such as guide channel 63, may be plugged while the perforation alignment tool is to be used for jet-cleaning perforations or forming new perforations. Plugging of guide channel 63 may be by a wire line-set plug, by a valve in guide channel 63 actuated from the surface using known techniques for remote valve activation, by dropping a ball to seat at the entrance to guide channel 63, or other means of plugging channels that are known in the art. With guide channel 63 plugged, fluid flow from chamber 61 exits through ports 62 into flow channels 72, then into manifold 73 and from there into flow channel 74. High-pressure fluid is provided to nozzles 75, which may be used to form new perforations 77 and 78. The new perforations will be located at known distance along the well bore and at a known phase angle with respect to initial perforation 11*c*. Fluid will be injected down tubing 13 at a selected pressure and rate for a selected time sufficient to form perforations 77 and 78 in casing 11. Alternately, perforations 77 and 78 may be present when assembly 90 is placed in the well and may be cleaned by high-pressure fluid jets from nozzles 75. FIG. 7*a* shows an isometric isolated view of chamber 61, ports 62*a* and 62*b*, flow channels 72*a* and 72*b*, manifold 73 and the upper segment of guide channel 70.

FIG. 7 illustrates the use of perforation alignment tool assembly 90 that may be used for jet drilling into subterranean formation 15 for a selected distance. In some applications, plunger unit 40 may be moved up, along with sections 60 and 65 of the tool, so that plunger unit 40 is now aligned in new perforation 78, which may have been formed by high pressure jets from nozzles 75 before assembly 90 is moved upward in the wellbore. (This application is illustrated in FIG. 7.) New perforation 77 may now be used to form a lateral drain hole into formation 15, using new perforation 78 as a reference perforation. For this operation, tubing 18, which may be coil tubing, is placed in the well and at the bottom of tubing 18 is seal unit 80, having O-rings 81, that is sized to form a seal between seal unit 80 and channel 63. High pressure fluid can then be pumped down coil tubing 18 and into flexible drilling hose 82 and jet drill bit 84 while flow from coil tubing 18 cannot exit port 62. With coil tubing 18 located such that seal unit 80 is in guide channel 63, fluid can also be pumped down tubing 13 and exit through port 62 and be available for forming additional perforations or jet cleaning of perforations, as described above. The length of flexible drilling hose 82 is selected dependent upon the distance that a drain hole is to be drilled through perforation 77 and into formation 15. The length of section 64 will be selected based on the length of flexible drilling hose 82 that will be used for drilling. Seal unit 80 may be placed such that fluid can be pumped either down the tubing 13 for forming new perforations or down coil tubing 18 for jet drilling into formation 15, or both. Seal unit 80 may be lowered on coil tubing 18 into larger diameter guide section 64, so that reduced frictional force is exerted on the tubing as drilling proceeds. For example, when the length of flexible hose 82 is 15 feet, the length of chamber 61 may be 1 foot, the length of guide channel 63 may be 2 feet, the length of guide channel 64 may be 15 feet and the length of guide channel 70 may be 2 feet, which will enable one to drill a 13 feet-long lateral. The length of lateral drain hole drilled depends upon the requirements or advantages of a drain hole in each well. That distance may be 1 or 2 feet or tens or even hundreds of feet, depending on the properties of the formation to be drilled and the benefits derived from drain holes of differing lengths. For lengths of drain hole greater than about 20 or 30 feet, the length of the tool to contain the flexible hose becomes inconvenient. It may be preferable to drill the longer laterals by withdrawing coil tubing 18 from the tool after perforating the casing and attaching the required long lengths of flexible hose 82 and nozzle 84 to the coil tubing. The lateral can then be drilled by reinserting nozzle 84 and flexible tubing 82 through assembly 90.

Drill bit 84 for drilling through a formation is preferably the bit disclosed and claimed in U.S. Pat. No. 6,668,948. This bit allows a force directed along the flexible hose to pull the bit into a hole that is being drilled. This force is provided by backward directed jets in the drill bit. Alternatively, any jet drill bit may be used.

Figure 8:
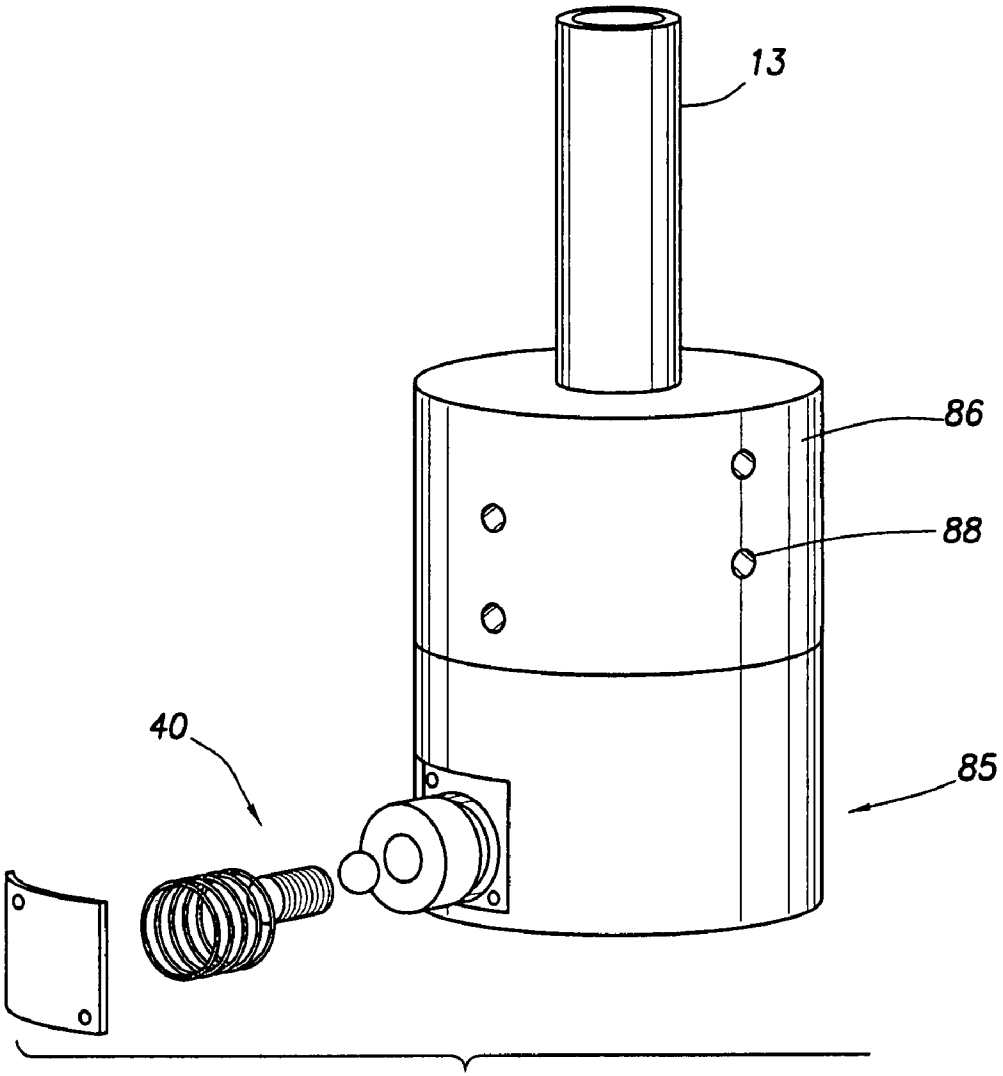
FIG. 8 is a perspective view of a perforation alignment tool assembly configured for forming perforations using a conventional perforating apparatus.

FIG. 8 illustrates how perforation alignment tool assembly 85 may be used along with a reference perforation to form additional perforations using conventional perforating equipment. Plunger unit 40 (FIG. 4*a*) is a part of perforation alignment tool assembly 85 and may be used to align the assembly to a reference perforation when it is lowered into a well on tubing 13. Perforating tool 86, a part of perforation alignment tool assembly 85, may be a conventional perforating tool, and is preferably a hollow carrier tool. Alternative perforating tools such as strip jet perforators using shaped charges, bullet perforators or other jet perforators may be used. Centralizers may be used above, below or on assembly 85 (not shown). Exit areas 88 in hollow carrier tool 86 are located at known angular directions and distances with respect to plunger unit 40, which may be aligned to and in a reference perforation. Thus new perforations may be formed at a known location with respect to a reference perforation.

To perform the operation of jet cleaning one or more perforations or jet drilling through one or more perforations, at least one plunger unit may be aligned in a perforation. If the pattern of perforations is known, a perforation alignment tool configured for the operation to be performed may be constructed. If the location or pattern of existing perforations in a well is not known, the pattern may be determined by running a caliper log, an impression packer, a TV camera or other tool in the well to locate perforations. A customized perforation alignment tool assembly may then be constructed for any perforation pattern in a well. Using one or more of the perforations in the pattern as a reference perforation, other perforations may then be jet cleaned or drain holes may be drilled through selected perforations.

If more detailed information is not available, well records normally contain the number and phasing of perforations in a casing of a well. The depth of perforations in a casing may also be identified from logs run in the well, such as electric logs run along with a collar locator. By whatever method the depth of perforations is determined, that information may be used to make an initial determination of location of a perforation alignment tool on tubing. If jets for washing perforations are located on a perforation alignment tool assembly above the plunger or plungers used to align the assembly to the perforation, it may be advantageous to locate the top plunger in the lowest perforation in the well. This may be achieved by lowering the perforation alignment tool and jetting assembly into the well to a depth such that the plungers are below existing perforations. The tool may then be slowly pulled upward while rotating the tubing clockwise slowly, which may employ a wrench at the surface. When a plunger enters a perforation, an increase in the tubing weight may be observed at the surface or a weight indicator on the rig may be observed to increase. Alternatively, an acoustic response may be observed in the tubing by an electronic microphone or by a simple mechanical detector such as a stethoscope. Additional plungers may be observed to align with a perforation as tubing is moved upward, causing further increases in the observed force required to move the tubing or measured weight on a weight indicator.

If perforations over the interval to be treated by the tool in the well are regular or are known and correspond to the pattern of jet nozzles on the perforation alignment tool assembly, then perforation cleaning may proceed by pumping down the tubing. Perforation cleaning operations may be varied depending on the properties of the formation where the perforations are present. The nozzles inserted into the body of a tool, such as illustrated in FIG. 3B, may be erosion-resistant nozzles having dimensions of 5⁄32 inch diameter and a length of about 0.5 inches, for example, which are widely available in industry and which may be purchased from service or supply companies. For example, carbide nozzles may be obtained from Quality Spray Products Company of Elmhurst, Ill. Nozzles used for cleaning perforations by jetting preferably have an orifice in the form of a straight bore with a length in the range from about 0.1 inch to about 0.5 inch. Diameter of the orifice may be in the range from about 0.025 inch to about 0.3 inch, preferably in the range from about 0.06 inch and about 0.15 inch. A nozzle described in U.S. Pat. No. 6,668,948, containing a swirling full cone, can be used effectively to jet-clean perforations. The front orifice diameter of this nozzle can range from about 0.025 inch to about 0.25 inch, with a typical value being 0.150 inch. A pump capable of pumping fluid at surface pressures of about 5,000 PSI and at a rate of at least 4 barrels per minute is preferred. Pressure required for jet-cleaning perforations depends on the type formation and the type solids in a perforation to be cleaned. The fluid typically used to jet clean perforations is filtered water or water containing sand or other particles at a concentration in the range from about 0.2 pounds per gallon to 1 pound per gallon. Guar polymer or other polymer may be added to the water to reduce friction loss as fluid is pumped downhole, using polymer concentrations well known in industry. Other chemicals, such as potassium chloride or surfactants to help wet and disperse solids may be added to the water to increase compatibility with the reservoir formation. Pumping may continue for several minutes, normally in the range from about 1 minute to about 10 minutes. The tubing may then be raised until observation, a weight indicator or an acoustic detector indicates that the plungers have engaged another perforation or other perforations. The nozzles are then pointing at the next higher perforations to be cleaned. Again, fluid is pumped down the tubing string and through the nozzles. When all the desired perforations are cleaned, the tool is flushed with clean water and removed from the well.

To use perforation alignment tool assembly 90 of FIG. 6 for forming new perforations in casing at a known location with respect to a reference perforation by jet drilling, one or more plunger units 40 may be attached to the tool, such as shown in FIG. 6. A plunger is aligned with and enters the reference perforation, such as perforation 78 of FIG. 7. Nozzle 75 is preferably an abrasive-resistant nozzle. The nozzles selected are determined by the width of the perforation to be formed and the depth of penetration that is desired. For example, a Venturi nozzle may be used to increase the perforation diameter, while a straight bore nozzle may be used for increased penetration. Typically for perforating a casing, the orifice is a Venturi-type with a diameter of approximately 0.2 inch. The pattern of perforations may be selected to be 4 shots per foot at 90 degree phasing, for example. The perforation phasing may vary from 0 to ±180 degrees. In FIG. 7, zero-degree phasing is illustrated for nozzles 75. The nozzles may be obtained from industry supply or service companies or may be fabricated in a machine shop. When the plunger has been seated in a selected perforation, a pump for pumping fluids will preferably be capable of pumping abrasive fluids at pressures of at least about 5,000 psi and at a rate of at least 4 barrels per minute. The pump is attached to the top of the tubing at the well head. Channel 63 is plugged by using previously mentioned procedures to that fluid cannot go through channel 70, if present. The drilling fluids typically used to drill perforations are filtered water containing sand or other particles at a concentration of 0.2 to 1 pound per gallon and a polymer for friction reduction. Pumping rate is typically in the range from about 0.25 barrel per minute to about 4 barrels per minute per nozzle. After about 5 minutes the pump may be turned off to allow the fluid to drain from the tubing. Then the tool may be raised vertically an appropriate distance until the weight indicator or another detector indicates that plungers have engaged new perforations. Again, fluid is pumped down the tubing and the process of drilling holes by hydraulic jets is repeated. When all the desired perforations are created, the tool may be flushed with clean water and removed from the well.

Referring to FIG. 7, perforation alignment tool assembly 90 may be used for drilling a drain hole through a perforation into the surrounding formation. Tubing 18 with seal unit 80, elastomeric tubing 82 and jet drill bit 84 attached at the bottom of tubing 18 is placed in the well. When a drain hole is to be formed through a perforation, tubing 18 is lowered in the well such that drill bit 84 on elastomeric tube 82 is brought into perforation 77. Seal unit 80 will preferably be located within guide channel segment 64. A high pressure pump attached to tubing 18 is then started to begin the drilling. Usually return fluid flows around assembly 90 and up the tubing-casing annulus. Coil tubing 18 is lowered down in accordance with the speed that nozzle 84 moves through formation 15, while monitoring weight of the tubing. Once the lateral hole is completed, coil tubing 18 is withdrawn from the well, along with elastomeric tubing 82 and drilling nozzle 84. Tubing 18 may be withdrawn only enough to remove nozzle 84 from perforation 77 and tubing 13 may then be rotated at the same depth and another hole drilled using the same procedure. Alternatively, tubing 13 may be moved to a next desired perforation and another lateral hole be drilled through the perforation as described above.

The force available to maintain the perforation alignment tool in a fixed position, with one or more plungers locked into a reference perforation, may be measured in the shop for different size plungers and balls, different size perforations, temperature and other variables. The force required in a particular perforated well may be measured while pulling upward on tubing with a weight indicator on the tubing and at least one plunger in a perforation.

Figure 9:
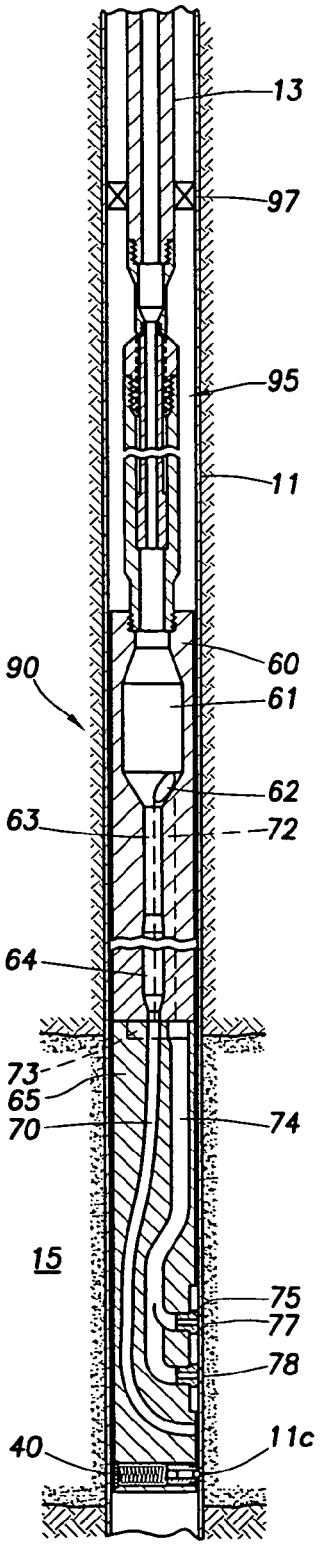
FIG. 9 is a cross-sectional view of a perforation alignment tool assembly configured for jetting to form perforations or to jet-clean perforations at a selected location above a reference perforation and having apparatus to prevent movement of the tool assembly during pumping operations.

Calculations of the force required to maintain the bottom of tubing string 13 fixed or calculations of the amount of movement of the bottom of tubing 13 if not fixed during a pumping operation may be performed using well known analytical methods and the downhole configuration of equipment to be used. Such calculations may indicate that a perforation alignment tool or multiple perforation alignment tools will not provide sufficient force to maintain a fixed position. To prevent movement of a perforation alignment tool out of a perforation during pumping operations, two types devices may be employed: (1) A packer or tubing anchor may be used on the bottom of the tubing near the perforation alignment tool to provide additional force to fix the bottom of the tubing (the packer must be set after the plunger of a perforation alignment tool is in a perforation); (2) a slip joint may be placed between the tubing string and the perforation alignment tool to compensate for tubing movement; or (3) both types of devices may be employed. FIG. 9 illustrates slip joint 95 between assembly 90 and tubing string 13. Slip joint 95 will be described in more detail below. Also illustrated in the figure is device 97, which may be a centralizer, preferably a spring centralizer that will provide frictional force resisting movement of the bottom of tubing 13, or may be a device such as a packer to fix the bottom of tubing string 13 with respect to casing 11. Pressure and temperature changes in tubing string 13 may cause an increase or a decrease in the length of tubing string 13. Slip joint 95 will normally be lowered into a well in an extended position. Tubing may be pulled upward, while rotating the tubing string, to seat a plunger in a perforation, as described above. Slip joint 95 is constructed to allow torque to be transmitted through slip joint 95 and to assembly 90 as tubing string 13 is rotated. After perforation alignment tool assembly is positioned such that a plunger is fixed in a perforation or perforations, tubing 13 may be lowered or "slacked off" so that slip joint 95 is in an intermediate position between fully extended and fully retracted, which will allow for either contraction or extension of tubing string 13 during pumping operations without movement of a plunger from a perforation.

A suitable packer to be placed on tubing 13 would be a mechanical retrievable packer that is well known in industry, such as those available from Baker-Hughes, Inc. The packer would contain an opening to allow fluid flow through the packer and up the tubing-casing annulus. For example, a packer designed for dual tubing strings may be used and one of the openings left open for flow through the packer. Also, a tubing anchor may be used, which fixes the bottom of the tubing but allows flow past the device. Such device is available from BJ Services. Also, a packer may be used on tubing attached below assembly 90 (not shown). A packer used below may or may not include a flow channel through the packer.

Figure 10A:
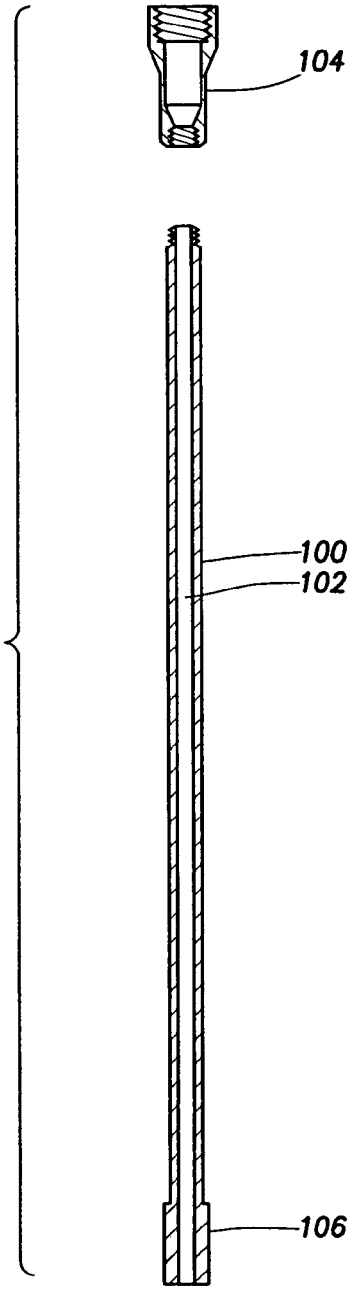
FIGS. 10*a*, 10*b*, 10*c* and 10*d* are cross-sectional views of a slip-joint device to compensate for tubing movement during pumping operations with a perforation alignment tool.
Figure 10B:
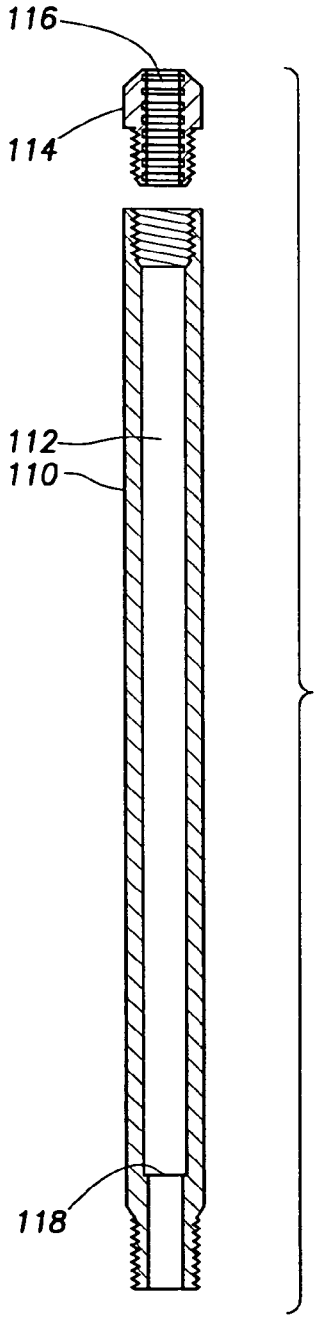
Figure 10C:
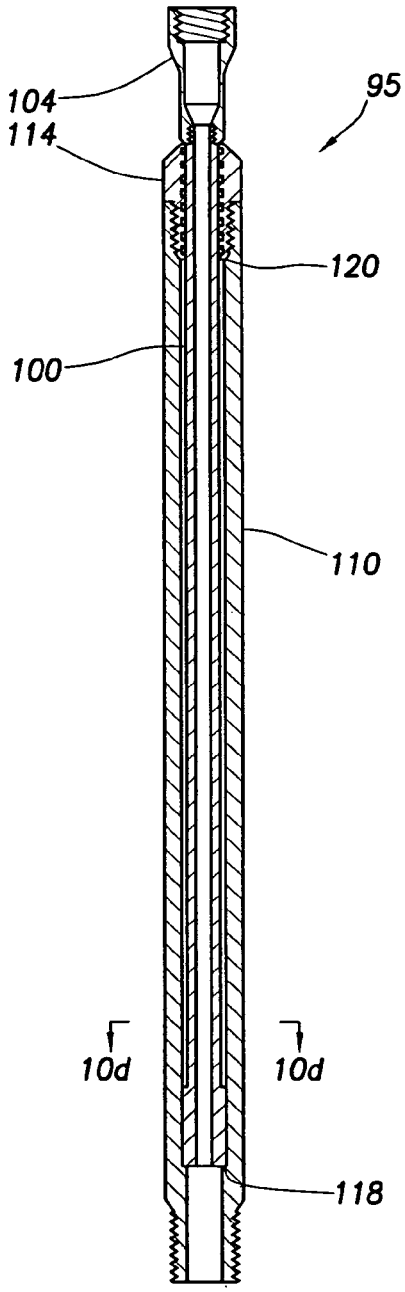
Figure 10D:
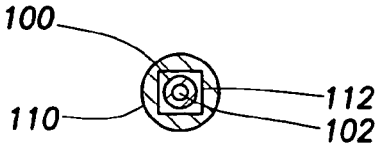

FIGS. 10*a*, 10*b*, 10*c* and 10*d* illustrate a slip joint that may be used to isolate movement of the bottom of tubing string 13 from assembly 90, as shown in FIG. 9, thus allowing assembly 90 to remain fixed in a stationary position as pumping occurs down tubing string 13. FIG. 10*a* illustrates rod 100, having flow channel 102 therethrough. Rod coupling 104 may be attached to rod 100 and may be used to couple the rod to a tubing string. Rod 100 may be round or non-round, but at least a segment 106 of rod 100 is not round. Segment 106 may be square, for example. This allows torque to be transmitted from rod 100 to a surrounding structure. Alternatively, rod 100 may include a protuberance that is adapted to slide in a groove or may have other structure to allow transmission of torque from the rod. FIG. 10*b* illustrates cylinder 110, which is adapted to receive rod 100. Bore 112 of cylinder 110 may be square, for example, or may contain a groove (not shown) to allow transmission of torque from a rod in the cylinder. Cap 114 may be removed for insertion of rod 100 into cylinder 110. Cap 114 contains seals 116, which are adapted to prevent fluid flow between rod 100 and cylinder 110. Normally, rod 100 is round except for segment 106 and seals 116 are adapted to seal around a round surface. FIG. 10*c* illustrates rod 100 inserted into bore 112 of cylinder 110. The fully retracted position of slip joint 95 is attained with rod 100 inserted into cylinder 110 to the maximum extent and with segment 106 contacting shoulder 118 in bore 112 of cylinder 110 The fully extended position of slip joint 95 is attained with rod 100 inserted into cylinder 110 such that segment 106 or a protuberance on rod 100 contacts shoulder 120, which may be in cap 114. The length of rod 100 and cylinder 110 may be adjusted to provide sufficient movement during pumping operations to prevent forces resulting from tubing movement to be transmitted to a perforation alignment tool. FIG. 10*d* illustrates a cross-section shown in FIG. 10*c*. Cylinder 110 has square bore 112, which is adapted to allow sliding movement of segment 106 therethrough. Rod 110, containing flow channel 102, is round at the cross-section and adapted to seal when passing through seals 116 (FIG. 10*b*).

Although the present disclosure has been described in detail, it should be understood that various changes, substitutions and alterations can be made thereto without departing from the scope and spirit of the invention as defined by the appended claims.

What we claim is:

1. Apparatus for fixing a second apparatus to a reference perforation in a well casing, the well casing having an inside surface, comprising:

a first body, the first body being adapted to move through the well casing;

a plunger having a first end and a second end and a lateral surface therebetween, the lateral surface having a shoulder therein and being adapted to move through a bore in the first body to a stop, the stop being disposed such that the first end extends beyond the first body a selected distance when the shoulder contacts the stop; and a spring mechanism adapted to force the plunger through the body to bring the shoulder in contact with the stop.

2. The apparatus of claim 1 wherein the first end of the plunger is arcuate.

3. The apparatus of claim 1 wherein the plunger further comprises a bore intersecting the first end, the bore having a ball therein, the ball being confined to the bore and adapted to extend beyond the first end of the plunger.

4. The apparatus of claim 1 further comprising a plurality of plungers and spring mechanisms.

5. Apparatus for directing a fluid jet at a selected location with respect to a reference perforation in a casing of a well, comprising:

the apparatus of claim 1; and a second apparatus attached to or contiguous with the apparatus of claim 1, the second apparatus having a second body, the second body having a fluid conduit through the second body to a port adapted to receive a nozzle, the port being disposed at a selected distance and a selected phase angle with respect to the first end of the plunger of the apparatus of claim 1.

6. The apparatus of claim 5 further comprising a nozzle.

7. The apparatus of claim 6 wherein the nozzle is adapted for forming a perforation in the casing.

8. The apparatus of claim 6 wherein the nozzle is adapted for jet-cleaning a perforation in the casing.

9. The apparatus of claim 5 further comprising a plurality of fluid conduits to a plurality of ports or nozzles.

10. A slip joint for decreasing axial force and transmitting torque to equipment attached to the bottom of a tubing string in a wellbore during pumping operations through the tubing, comprising:

a cylinder having a bore therethrough, a segment of the bore having a shape that is not round;

a rod adapted to move through the bore to a stop at each end of the bore, the rod having a flow channel therethrough and a segment that is not round, so as to allow transmission of torque from the rod to the cylinder;

a seal to prevent fluid flow along the bore between the cylinder and the rod; and means for attaching the rod and the cylinder to the tubing string and the equipment.

11. The apparatus of claim 10 wherein the shape of the bore and the segment of the rod is square.

12. The apparatus of claim 10 wherein the bore contains a groove or protuberance.

13. Apparatus for directing a fluid jet toward an inside surface of a casing for jet drilling through a perforation in the casing, comprising:

the apparatus of claim 1; and a body adapted to be coupled to a tubing string, the body having therein a fluid chamber, a fluid channel leading to a nozzle and a guide channel leading to a guide port in the body, the fluid chamber having an entrance port in fluid communication with the tubing string and the fluid channel and the guide channel being adapted to guide a hose through the body to the guide port.

14. The apparatus of claim 13 wherein the guide channel is comprised of segments having varying dimensions.

15. A method for performing a pumping operation in a well in a subterranean formation having a casing and a perforation in the casing, comprising:

placing a first tubing string in the well, the first tubing string having a plunger unit attached thereto, the plunger unit having a spring-loaded plunger, the plunger adapted to at least partially penetrate a reference perforation when opposite thereto and the plunger unit being attached to an apparatus in fluid communication with the first tubing string and having a fluid channel leading to a nozzle directed at a known location with respect to the plunger;

manipulating the first tubing string so as to cause the plunger to at least partially penetrate the reference perforation; and pumping fluid down-the first tubing string at a selected pressure and rate and through the nozzle so as to perform the pumping operation.

16. The method of claim 15 wherein the pumping operation is directing a fluid jet so as to form a perforation in the casing.

17. The method of claim 15 further comprising, before placing the plunger unit and the apparatus attached thereto in the well, determining the location with respect to the reference perforation of a perforation to be cleaned and selecting apparatus having the nozzle directed to the perforation to be cleaned, and the pumping operation is jet-cleaning of the perforation.

18. The method of claim 15 wherein the apparatus in fluid communication with the first tubing string and having a fluid channel leading to a nozzle directed at a known location with respect to the plunger further comprises a guide channel leading to a guide port directed toward the inside surface of the casing and further comprising plugging the guide channel before pumping fluid down the first tubing string.

19. The method of claim 18 wherein plugging the guide channel before pumping fluid down the first tubing string comprises placing a second tubing string inside the first tubing string, the second tubing string having a seal unit attached thereto, and positioning the seal unit so as to plug the guide channel.

20. The method of claim 15 further comprising placing the slip joint of claim 10 between the first tubing string and the apparatus in fluid communication with the first tubing string before the first tubing string is placed in the well.

21. The method of claim 15 further comprising placing on the first tubing string before the first tubing string is placed in the well a device to fix the bottom end of the first tubing string to the casing, and after the step of manipulating the first tubing string so as to cause the plunger to at least partially penetrate the reference perforation, then operating the device to fix the bottom end of the first tubing string with respect to the casing.

22. A method for forming a perforation in the casing of a well in a subterranean formation, comprising:

placing a first tubing string in the well, the first tubing string having a plunger unit attached thereto, the plunger unit having a spring-loaded plunger, the plunger adapted to at least partially penetrate a reference perforation when opposite thereto and the plunger unit being attached to an apparatus having a guide channel leading to a guide port directed at a known location with respect to the plunger;

manipulating the first tubing string so as to cause the plunger to at least partially penetrate the reference perforation;

placing a second tubing string inside the first tubing string, the second tubing string having a flexible tubing attached thereto and a jet nozzle attached to the flexible tubing;

passing the nozzle and the flexible tubing through the guide conduit so as to bring the nozzle in proximity to the guide port and in proximity to the casing; and pumping fluid at a selected rate through the nozzle for a selected time so as to form a perforation in the casing at a known location with respect to the reference perforation.

23. The method of claim 22 further comprising placing the slip joint of claim 10 between the first tubing string and the apparatus in fluid communication with the first tubing string before the first tubing string is placed in the well.

24. The method of claim 22 further comprising placing on the first tubing string before the first tubing string is placed in the well a device to fix the bottom end of the first tubing string to the casing, and after the step of manipulating the first tubing string so as to cause the plunger to at least partially penetrate the reference perforation, then operating the device to fix the bottom end of the first tubing string with respect to the casing.

25. A method for drilling a drain hole through a perforation in the casing of a well in a subterranean formation, comprising:

determining the location with respect to a reference perforation of a perforation through which a drain hole is to be drilled;

selecting a plunger unit having a plunger and a second apparatus attached thereto, the second apparatus having a guide channel leading to a guide port directed to the location when the plunger is in the reference perforation;

placing a first tubing string in the well, the first tubing string having the plunger unit and the attached second apparatus on the tubing string;

manipulating the first tubing string so as to cause the plunger to at least partially penetrate the reference perforation;

placing a second tubing string inside the first tubing string, the second tubing string having a flexible tubing attached thereto and a jet nozzle attached to the flexible tubing;

passing the nozzle and the flexible tubing through the guide channel so as to bring the nozzle through the guide port and the perforation; and pumping fluid at a selected rate through the nozzle for a selected time so as to jet drill a drain hole into the formation.

26. The method of claim 25 further comprising placing the slip joint of claim 10 between the first tubing string and the apparatus in fluid communication with the first tubing string before placing the first tubing string in the well.

27. The method of claim 25 further comprising placing on the first tubing string before the first tubing string is placed in the well a device to fix the bottom end of the first tubing string to the casing, and after the step of manipulating the first tubing string so as to cause the plunger to at least partially penetrate the reference perforation, then operating the device to fix the bottom end of the tubing string with respect to the casing.

* * * * *